United States Patent [19]

Mills

[11] Patent Number: 4,791,430

[45] Date of Patent: Dec. 13, 1988

[54] ULTRASONIC ANTENNA

[75] Inventor: David J. Mills, Kewdale, Australia

[73] Assignee: Agtronics Pty. Limited, Kewdale, Australia

[21] Appl. No.: 895,769

[22] Filed: Jun. 12, 1986

[51] Int. Cl.[4] ..... H01Q 19/10

[52] U.S. Cl. ..... 343/837; 367/103; 367/119; 367/138; 310/335

[58] Field of Search ..... 343/837, 912; 310/322, 310/328, 332, 334, 335; 367/103, 119, 138, 151

[56] References Cited

U.S. PATENT DOCUMENTS

| | | | |
|---|---|---|---|
| 3,742,442 | 6/1973 | Leyde et al. | 367/151 |
| 3,965,455 | 6/1976 | Hurwitz | 367/151 |
| 3,974,475 | 8/1976 | Burckhardt et al. | 367/103 |
| 4,146,869 | 3/1979 | Snyder | 367/151 |
| 4,223,316 | 9/1980 | Drabowitch | 343/837 |
| 4,274,421 | 6/1981 | Dory | 367/103 |
| 4,330,874 | 5/1982 | Sorwick | 367/103 |
| 4,433,396 | 2/1984 | Johnson et al. | 367/151 |

*Primary Examiner*—William L. Sikes
*Assistant Examiner*—Robert E. Wise
*Attorney, Agent, or Firm*—Jenner & Block

[57] ABSTRACT

An ultrasonic antenna is mounted with an ultrasonic transducer on an agricultural implement and directs an ultrasonic burst directly towards the ground in front of the agricultural implement for the purpose of range finding. The transducer receives the reflected signal and, following signal processing, a computation is made of the height of the reference point on the implement above the ground. Ground tillage, seeding, and similar equipment including above ground harvesting implements can be controlled with the equipment. The antenna is characterized by a moulded body having a sensor mounting at one end and an opening at the other end with co-operating first and second concave surfaces for reflecting the ultrasonic beam between the sensor and the opening and vice versa. The first and second reflectors are of part cylindrical shape extending around respective axes arranged substantially at right angles to each other with the distance from the second reflector, which is nearer the opening of the antenna, to the virtual source of the transducer being substantially less than the radius of the curvature of the second reflector, whereby a slightly diverging transmitted ultrasonic beam of elongated cross-sectional shape is provided.

11 Claims, 2 Drawing Sheets

ULTRASONIC ANTENNA

FIELD OF THE INVENTION

The present invention relates to an ultrasonic antenna adapted for use with a transducer and for mounting on an agricultural implement for distance measuring purposes.

BACKGROUND OF THE INVENTION

Ultrasonic distance measurement has applications in agriculture in measuring and controlling depth of cultivation, depth of planting, the relative position of a header comb in harvesting, and other operations where non-contact distance measurement is required. Various proposals have been made for ultrasonic distance measurement including applications in the agricultural environment, for example as described in the present assignees Austrialian petty patent No. 545,608.

Antennas for various radiation systems are known including parabolic reflectors. With a transducer located at the focus of a parabolic reflector, a parallel beam of circular cross-sectional shape is produced. However, there are practical difficulties in mounting a transducer in such a position especially when apparatus suitable for ultrasonic use in agricultural applications is contemplated. Ruggedness and high resistance to vibration, shock and dust are required for agricultural purposes. Another problem of using a simple parabolic reflector arrangement is that the transducer mounting would be in the path of the beam and this would not only reduce the transmitted and received signal but also, very importantly, cause diffraction and subsequent widening of the beam.

Publications in the antenna field include U.S. Pat. No. 4,208,661 (Vokurka) and U.S. Pat. No. 3,792,480 (Graham). Vokurka concerns the use of two parabolic cylindrical surfaces co-operating with a point source of radiation. Graham discloses a system suitable for microwaves i.e. electromagnetic radiation and teaches the use of first and second reflectors respectively convex and concave and being, for example, part hyperbolic or part parabolic. The system provides an accurate parallel beam.

Neither Vokurka nor Graham address the question of ultrasound systems, (in which transducers are not of a point source type) and produce sound waves which compared with electromagnetic waves are (a) longitudinal waves and (b) of very much greater wavelength.

The present invention is directed towards a product using ultrasound and suitable for use in agricultural applications and this imposes considerable problems. The ground surface in agricultural applications varies considerably. Whereas ultrasonic height sensing from a smooth hard surface such as a roadway does not present problems, there is difficulty in producing reliable readings over a variety of different ground surfaces. Some surfaces will have been worked and therefore have hard lumps and stones on the surface as well as having a generally powdery characteristic resulting in considerable scatter of radiation and attenuation of the ultrasound signal rather than good reflection.

Furthermore, economic factors require that the sensor equipment be not only extremely rugged and resistant to vibration and dust but also must have a relatively low capital cost. Existing commercial ultrasonic transducers are acceptable in cost but have fairly wide-angle beams. A typical ultrasonic transducer has a signal amplitude of 70 percent of the axial value at a position 20° off its directional axis and even at 70° off the directional axis the signal amplitude can be 15 percent of the axial value. When these transducers are used to measure a target surface of varying reflectivity, for example the ground surface, it is common to obtain confusing echoes reflected from machine parts and the ground surface in a direction well off the directional axis of the transducer. In these circumstances it is difficult, and perhaps impossible, to obtain satisfactory settings of receiver gain and measurement thresholds to suit all operating conditions.

Accordingly it would be desirable to provide a well defined and controlled ultrasonic signal beam with a comparetively narrow form suitable for projecting a distance of the order of 650 mm from the machine mounting to the ground surface.

SUMMARY OF THE INVENTION

According to the present invention, there is provided an ultrasonic antenna adapted to co-operate with an ultrasonic transducer and comprising means for mounting the antenna in working interrelationship with the transducer and for directing an ultrasonic beam downwardly onto the ground, and first and second concave reflectors each being of part substantially cylindrical form extending around respective longitudinal axes which are arranged substantially at right angles to each other, and the reflectors being arranged such that ultrasound signals emitted by the transducer are reflected from the first reflector to the second reflector and then into space for range finding purposes and vice versa, and wherein the distance from the second reflector to the virtual source of the transducer is substantially less than the radius of curvature of the second reflector whereby a slightly diverging transmitted beam of elongated cross-sectional shape is provided, the direction of elongation being substantially parallel to the ground and in a direction at right angles to the axis of the first reflector.

Use of the present invention provides a well controlled slightly divergent beam of suitable shape for agricultural applications. A relatively small footprint can be arranged on the ground which permits scanning over a limited area which is large enough to avoid distortion of results due to reflections from small stones, but the beam is controlled to avoid spurious results from e.g. reflections off parts of the machine and inaccurate sensing due to "radial error". Radial error would occur with a conventional transducer having no antenna. Signal well off the axis of the transducer could be reflected e.g. from soil particles or stones, but the path length from the transducer to the point of reflection would be greater than the direct vertical distance from transducer to the surface plane of the soil.

Furthermore, the elongated shape of the beam can be effective in assisting averaging of a series of readings taken by the transducer.

The cylindrical form of the reflectors need not be of circular cross-sectional shape as other configurations such as parabolic could be used. However, it is most advantageous with embodiments of the invention to use circular shaped cylindrical reflectors. Such reflectors have no directrices, focal lines or unique planes of symmetry even though the transducer does not lie on the focal cylinder.

Preferably, the form of the reflectors and the sensor mounting is such that a downwardly transmitted beam of generally elliptical form is produced.

Preferably, the antenna is formed integrally as a rigid body, for example by moulding in a suitable material, the configuration of the reflectors being such that a single mould core may be used and extracted from the antenna.

Preferably, a plastics material such as an epoxy resin material is used for the material of the antenna, thereby avoiding static and corrosion problems that could arise with metal structures such as aluminium.

In a typical, advantageous embodiment, the first and second reflectors are spaced about 50 mm apart and are adapted to operate with a transducer having ultrasound of wavelength of about 8 mm.

Preferably, the means for mounting the antenna comprises a recess in a head region of the antenna with the axis of the transducer being arranged to direct a beam which, at the axis of the transducer, is incident on the central region of the first reflector at an angle of about 50° to the tangent to the reflector at the point of incidence.

The invention extends to the combination of an antenna in any one of the forms described above with an ultrasonic transducer, and also extends to an agricultural machine incorporating at least one sensor unit having an ultrasonic transducer co-operating with an antenna in any one of the forms described above.

BRIEF DESCRIPTION OF THE DRAWINGS

An embodiment of the invention will now be described, by way of example only, with reference to the accompanying drawings of which.

DETAILED DESCRIPTION OF THE DRAWINGS

Figure 1:
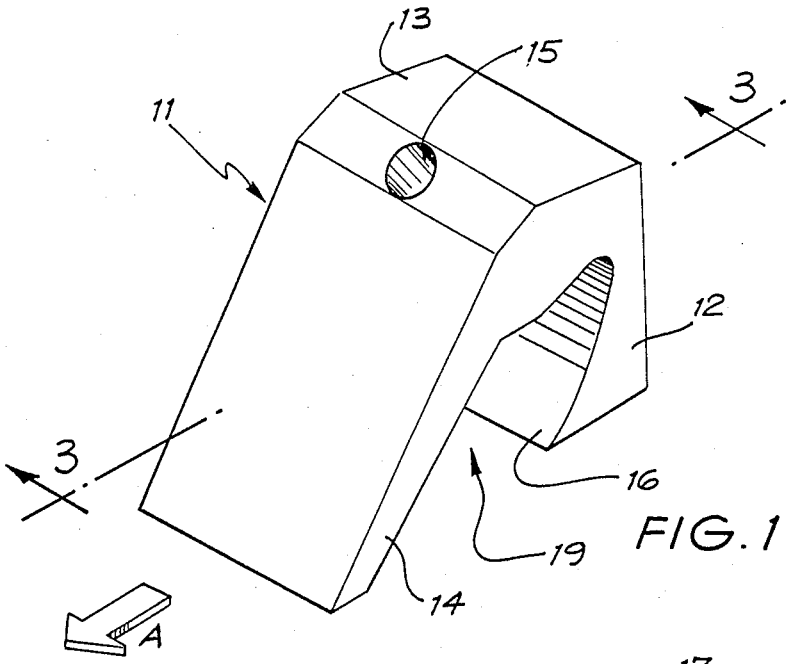
FIG. 1 is a perspective view from above of an antenna according to the embodiment.
Figure 2:
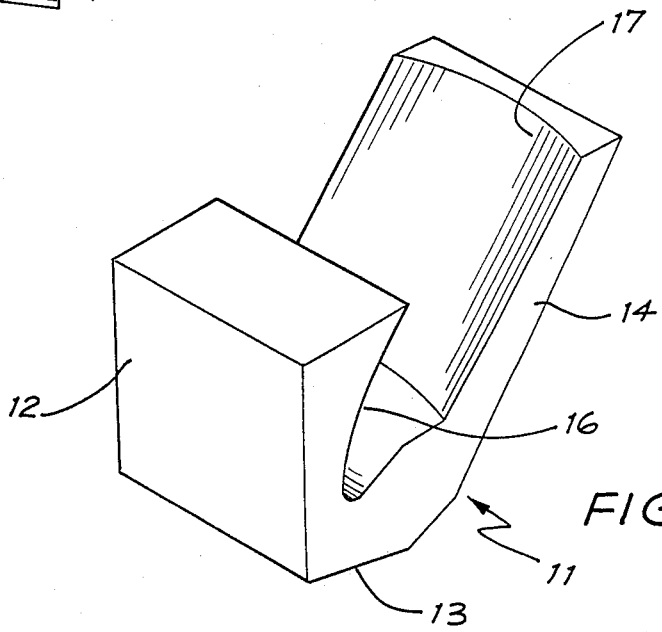
FIG. 2 is a perspective view from the underside of the antenna.
Figure 3:
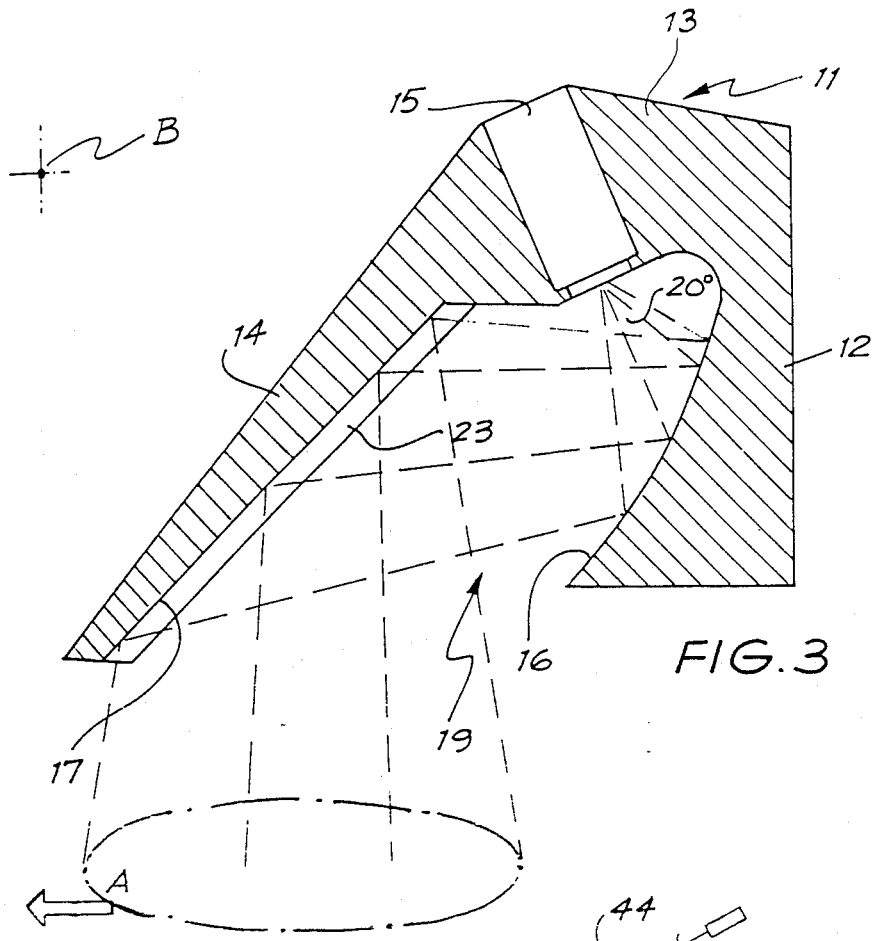
FIG. 3 is a section along the line 3—3 of FIG. 1.

The preferred embodiment of antenna, as shown in the drawings, is a rigid moulded body 11 of generally inverted U-shape form and including a head 13, rear leg 12 and frong leg 14. The antenna provides a downwardly directed ultrasound beam of generally elliptical cross-sectional shape which forms a footprint on the ground elongated in the direction of motion of the machine (which is indicated by arrow A in FIG. 3). The antenna is mounted on an implement at a convenient height which in the case of a typical ground working implement is about 650 mm above the ground level but in the case of other implements the height may vary generally in the range 500 mm to 200 mm. The beam is slightly divergent and FIG. 3 shows the beam pattern schematically. In practice the transducer produces a broader wavefront and is not a point source.

The antenna 11 is moulded conveniently in an epoxy resin formulation with suitable fillers and is stable against ultraviolet light. A very strong rigid structure sufficiently durable for agricultural purposes is produced.

The head 13 of the antenna has an angled bore 15 extending therethrough for accomodating a conventional ultrasound sensor which operates at about 40 kHz, the single transducer being connected to control circuitry so as to be switchable between transmit and receive modes. A short burst of ultrasound is transmitted and terminated before arrival of reflected sound; a micro-processor is arranged (a) to compute the distance from the sensor to the soil surface, (b) to average readings and (c) to make adjustments to the machine height setting, for example by automatic control of hydraulic circuitry.

A cavity 19 within the antenna is of divergent form so that a one-piece mould core can be removed after the moulding operation. The cavity includes first and second reflector surfaces 16 and 17 which are each of part cylindrical shape of circular form, the axis B of the first reflector 16 being at right angles to the plane of the drawing of FIG. 3 and the axis of second reflector 17 being at right angles and in the plane of the drawing and at an angle of about 45° to the vertical. The ultrasound beam has a conical form and is reflected onto an extended region of the second reflector 17. The radius of curvature of the second reflector 17 is greater than the distance from the reflector to the virtual source of the transducer. Typically the radius of curvature of the second reflector is about 200 mm and the distance from the centre of the reflector 17 to the virtual source of the transducer is about 100 mm.

The typical dimensions of the antenna are an overall height of about 120 mm with the second reflector 17 having an axial length of about 90 mm.

Use of the invention has permitted effective concentration of the ultrasound beam whereby even on ground surfaces giving a poor level of return signal, effective and accurate monitoring can be achieved despite the inevitable reduction in signal-noise ratio.

Figure 4:
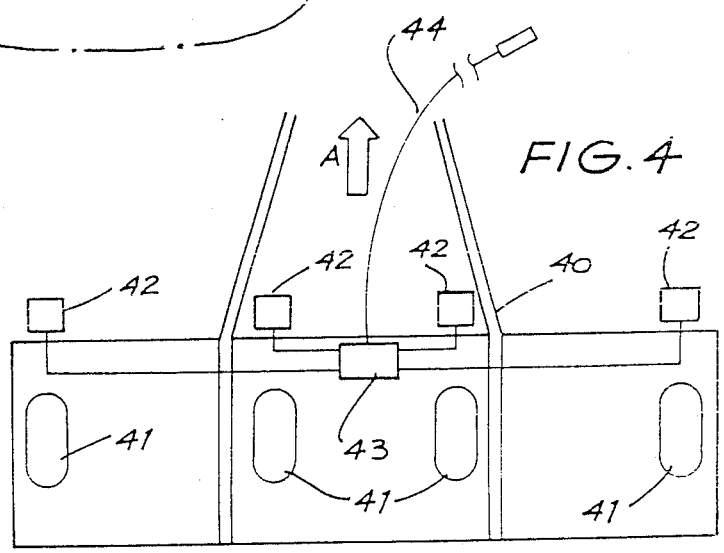
FIG. 4 is a schematic plan view showing typical sensor locations on an agricultural implement.

FIG. 4 illustrates in plan view a typical installation on a three section agricultural machine such as a seeding implement, in which the seed is deposited at a controlled depth below the soil surface. The machine is a trailing implement having four ground wheels 41, a central frame 40 and left and right wing sections 45 and 46 hingably connected to the centre section. Hydraulic rams (not shown) are provided in a conventional manner for adjusting the tools on the implement to a chosen height relative to the machine frame.

The present invention is implemented by the use of a series of four sensors 42 each comprising a transducer and an antenna and mounted at the front of the machine. The antennas have their respective front legs 14 directed forwardly of the machine and it is important that the sensors are not following wheel marks generated by a wheel of a tractor or the machine. Cabling 47 extends from each sensor to a junction box 43 from which a cable 44 leads to a micro-processing unit mounted on the tractor. The driver of the tractor sets the desired depth for the implement and this is automatically maintained by the micro-processor.

I claim:

1. An ultrasonic antenna adapted to co-operate with an ultrasonic transducer and comprising means for mounting the antenna in working interrelationship with the transducer and for directing an ultrasonic beam downwardly onto the ground, and first and second concave reflectors each being of part substantially cylindrical form extending around respective longitudinal axes which are arranged substantially at right angles to each other, and the first reflector being positioned to receive an ultrasonic beam from the transducer and to reflect the ultrasonic beam to the second reflector, with the sound reflector being positioned to receive the ultrasonic beam from the first reflector and then into space for range finding purposes, and wherein the distance from the second reflector to the virtual source of the transducer is less than the radius of curvature of the second reflector, whereby an ultrasonic beam from the transducer is reflected from the first reflector to the second reflector and is then reflected downwardly from the second reflector onto the ground at right angles to the axis of the first reflector.

2. An antenna as claimed in claim 1 and wherein each of said reflectors is of part-circular cross-sectional shape.

3. An antenna as claimed in claim 2 and wherein the second reflector has a radius of curvature of about 200 mm, and the distance from the second reflector to the virtual source of transducer is about 100 mm.

4. An antenna as claimed in claim 1 and wherein the reflectors direct an ultrasonic beam from the transducer downwardly in an elliptical cross-sectional shape.

5. An antenna as claimed in claim 1 and formed as an integrally molded rigid body of generally inverted U-shapeform, the reflectors being provided on the interior surfaces of the respective legs of the U-shape.

6. An antenna as claimed in claim 5 and wherein the antenna is moulded in epoxy resin material.

7. An antenna as claimed in claim 1 and wherein the means for mounting the antenna comprises a recess in a head region of the antenna with the axis of the transducer being arranged to direct a beam which, at the axis of the transducer, is incident on the central region of the first reflector at an angle of about 50° to the tangent to the reflector at the point of incidence.

8. An ultrasonic sensor unit comprising an ultrasonic sensor for providing an ultrasound wave beam and an antenna on which the transducer is mounted in working interrelationship for directing the ultrasound beam towards the ground surface, the antenna being as claimed in claim 1.

9. An agricultural machine having means for monitoring the distance from a reference point on the machine to the ground surface, the monitoring means including a sensor unit as claimed in claim 8.

10. An ultrasonic transducer unit comprising a molded body mounting a transducer and acting as an antenna, the molded body having means for mounting on an agricultural implement approximately 500 mm–200 mm above the ground, and an interior cavity in the body having a downwardly directed opening and first and second part-cylindrical reflectors extending around respective longitudinal axes which are arranged substantially at right angles to each other, and the first reflector being positioned to receive an ultrasonic beam from the transducer and to reflect the ultrasonic beam to the second reflector, with the second reflector being positioned to receive the ultrasonic beam from the first reflector and then into space for range finding purposes, and wherein the distance from the second reflector to the virtual source of the transducer is less than the radius of curvature of the second reflector, whereby an ultrasonic beam from the transducer is reflected from the first reflector to the second reflector and is then reflected downwardly from the second reflector onto the ground at right angles to the axis of the first reflector.

11. A transducer unit as claimed in claim 10, wherein the interior cavity is divergent, the reflectors are part-circular in section, the second reflector has a radius of curvature of about 200 mm and the distance from the second reflector to the virtual source of transducer is about 100 mm, and the second reflector has an axial length of about 90 mm and the axis is inclined at about 45° to the vertical.

* * * * *